United States Patent [19]

Bessett et al.

[11] 4,381,847

[45] May 3, 1983

[54] CARRY-OUT TRAY

[75] Inventors: Clifford H. Bessett, South Holland; Theodore H. Misdom, Lansing, both of Ill.

[73] Assignee: Packaging Corporation of America, Evanston, Ill.

[21] Appl. No.: 395,273

[22] Filed: Jul. 6, 1982

Related U.S. Application Data

[63] Continuation-in-part of Ser. No. 248,699, Mar. 30, 1981, abandoned.

[51] Int. Cl.[3] ..... B65D 1/34; B65D 1/36

[52] U.S. Cl. ..... 229/2.5 R; 229/30; 229/1.5 R

[58] Field of Search ..... 229/2.5 R, 1.5 R, 1.5 H, 229/30, 29 M

[56] References Cited

U.S. PATENT DOCUMENTS

| | | | |
|---|---|---|---|
| 2,766,919 | 10/1956 | Randall | 229/30 |
| 3,220,631 | 11/1965 | Reifers | 229/2.5 R |
| 3,638,849 | 2/1972 | Goings | 229/2.5 R |
| 3,647,104 | 3/1972 | Goings | 229/2.5 R |
| 3,915,371 | 10/1975 | Crabtree | 229/29 M |
| 4,218,008 | 8/1980 | Veilleux | 229/29 M |
| 4,219,144 | 8/1980 | Hagelberg | 229/30 |

*Primary Examiner*—Herbert F. Ross

*Attorney, Agent, or Firm*—Neuman, Williams, Anderson & Olson

[57] ABSTRACT

A molded carry-out tray is provided for use in accommodating cup-shaped containers which vary in size within a predetermined range. The tray comprises at least one recessed pocket for accommodating and maintaining a container in an upright position while the tray is disposed in a substantially horizontal plane. The pocket is provided with a base section which subtends and supportingly engages the bottom of the container when the latter is inserted to the fullest extent into the pocket. Extending divergently upwardly from the base section are walls which terminate at a common plane disposed at a predetermined elevation above the base section. Corner sections are disposed intermediate the walls and interconnect corresponding portions of adjacent walls. Each corner section is connected to a peripheral portion of the base section and extends upwardly therefrom. The corner sections and walls coact to form an open top. Each wall has an upper segment integrally connected to adjacent corner sections and an outwardly yieldable depending lower segment having the lower edge thereof disposed adjacent to, but spaced from, the periphery of the base section. Side edges of the lower segment extend upwardly from opposite ends of the lower edge and are spaced from corresponding side portions of the adjacent corner sections. Each corner section side portion is provided with a ledge which is recessed from the open top of the pocket and is offset inwardly towards the center of the pocket.

17 Claims, 17 Drawing Figures

FIG. 1
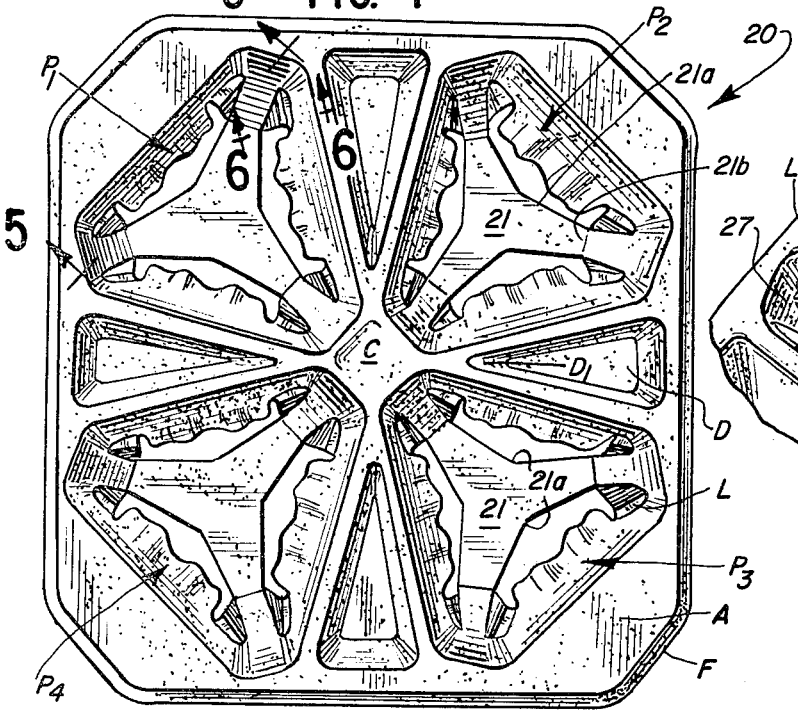
FIG. 4
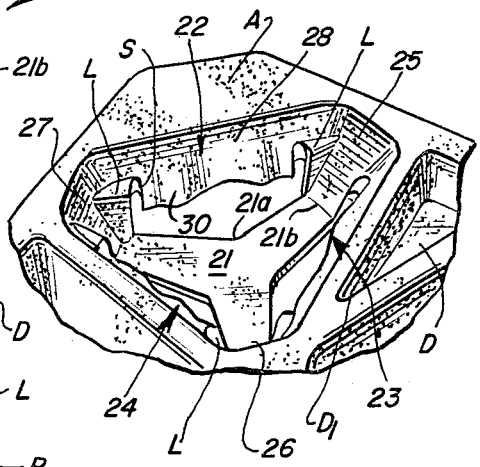
FIG. 2
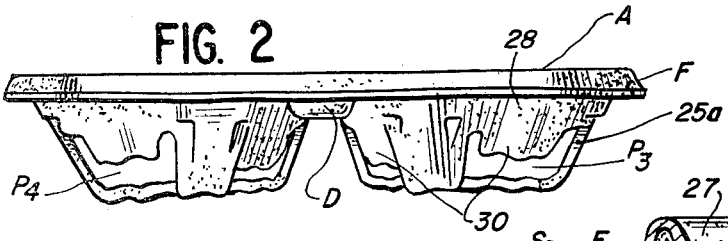
FIG. 5
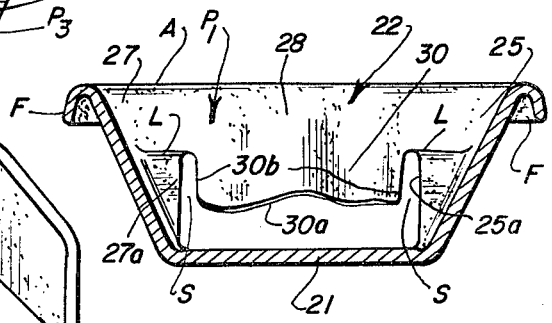
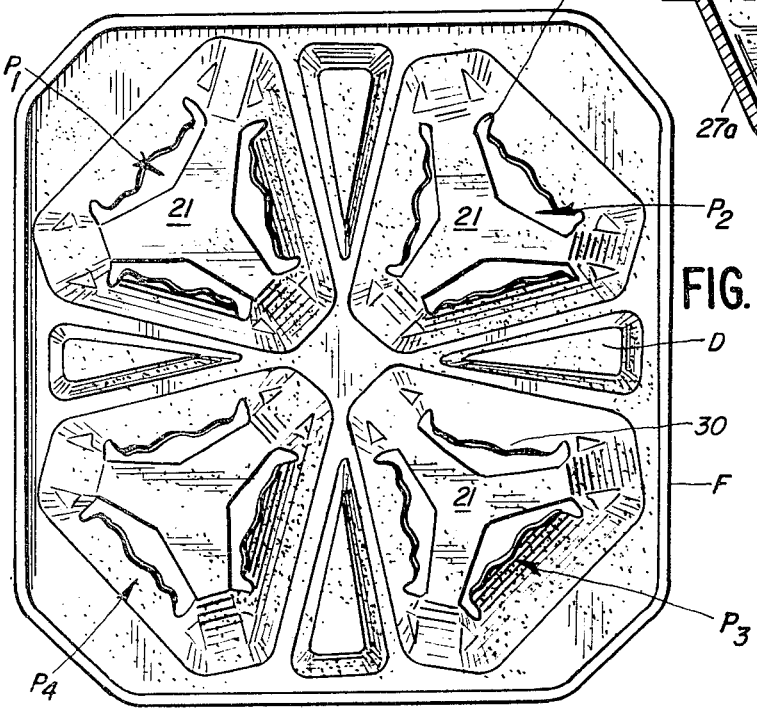
FIG. 3
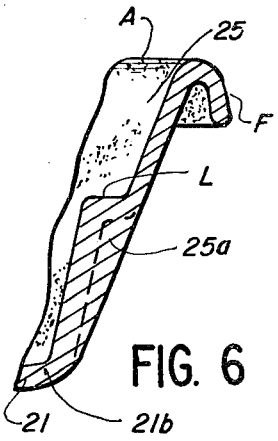
FIG. 6

FIG. 7
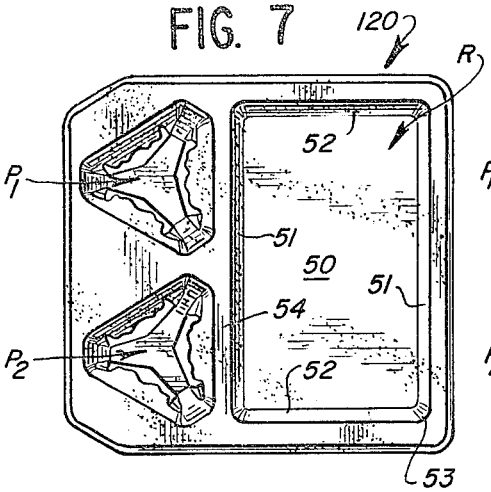
FIG. 9
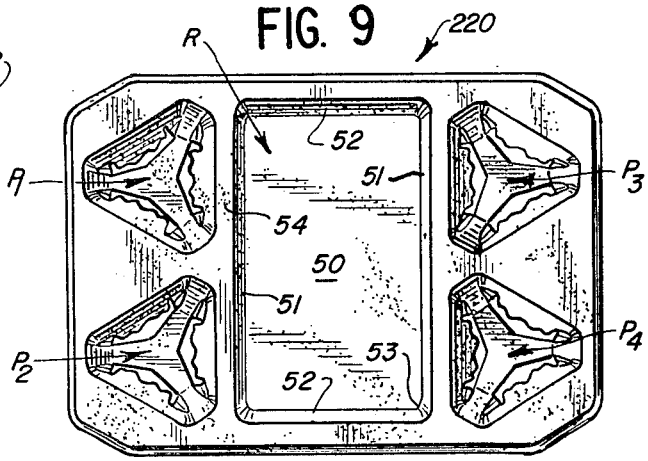
FIG. 8
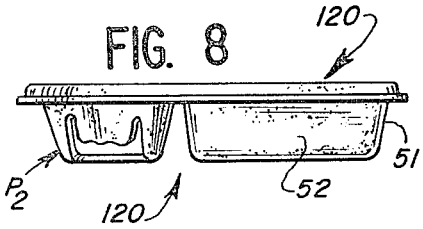
FIG. 10
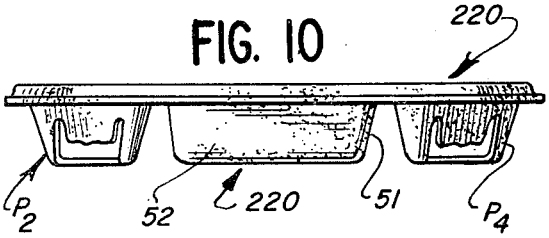
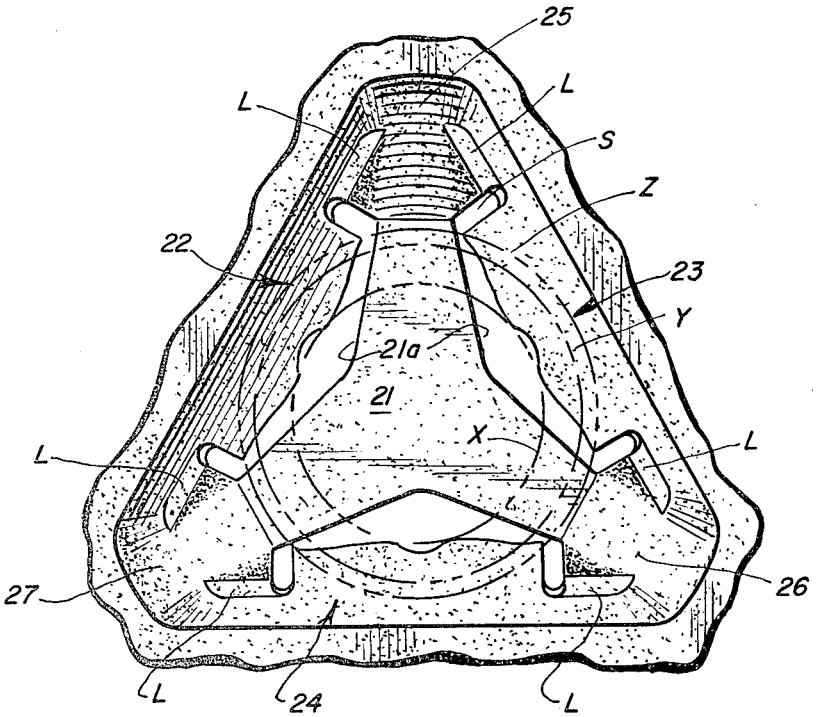
FIG. 11

FIG. 13
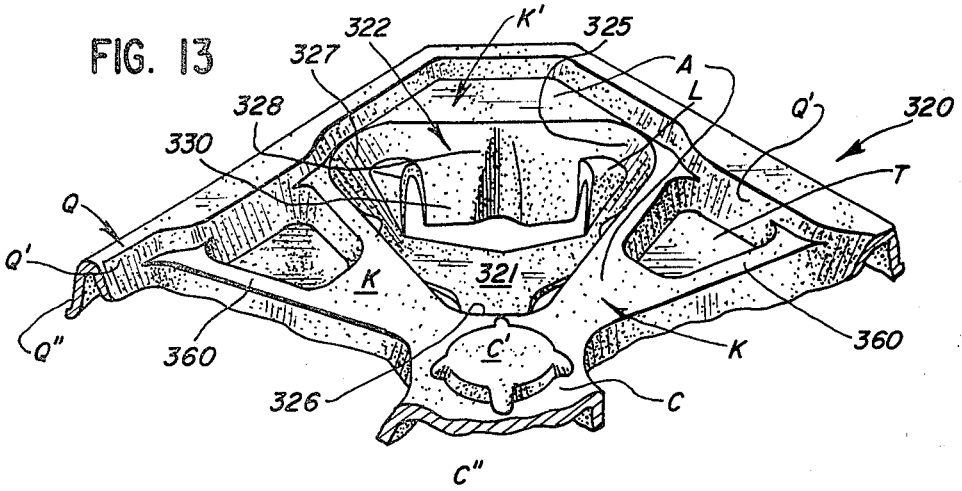
FIG. 14
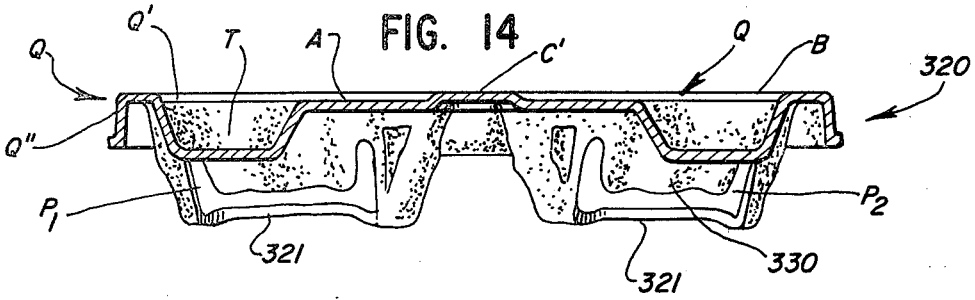
FIG. 15
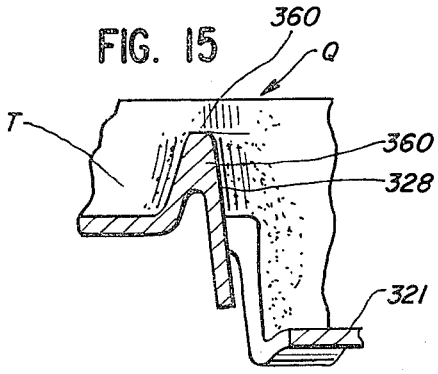
FIG. 16
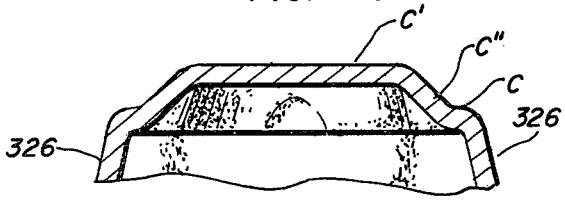
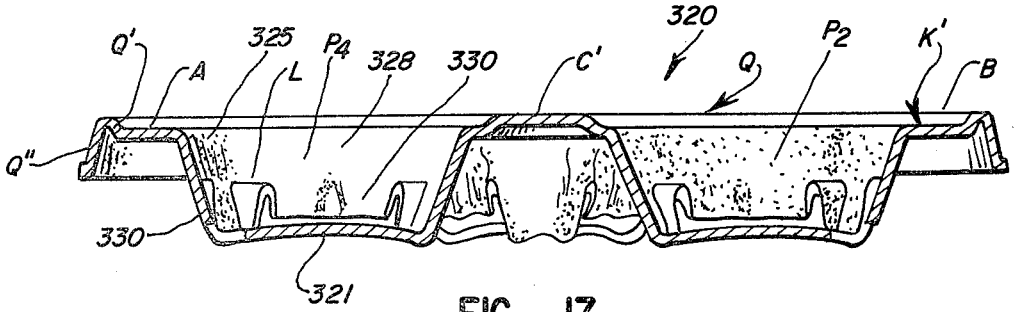
FIG. 17

CARRY-OUT TRAY

This application is a continuation-in-part of the copending application Ser. No. 248,699, entitled CARRY-OUT TRAY, filed Mar. 30, 1981, now abandoned.

BACKGROUND OF THE INVENTION

With the dramatic increased popularity in recent years of the fast-food type restaurants, various means have heretofore been provided to facilitate the handling of the purchased food and beverage items by the customer. Such means have included conventional paper bags, folding boxes, foil wrappers, and trays of various shapes and sizes. The instant invention is directed to trays utilized for this purpose.

Most of the more popular chains of fast-food stores are provided with tables and seating for the customer so that a significant amount of the food and beverage items is consumed on the store premise. As a convenience to customers desiring to eat and drink on the premise, the ordered items are normally placed on either a reusable or disposable tray at the service counter and then carried by the customer to a selected location within the store interior or out to the patio benches and tables provided on the outside of the store.

Various types of reusable trays formed of wood, plastics, or metal have heretofore been provided for this purpose; however, such trays are costly; are highly susceptible to being lost, stolen, or broken; in order to comply with various public health and sanitary rules and ordinances, each tray must be cleaned before being reused, and thus requires an inordinate amount of manual labor; adequate storage space must be provided for the trays; and the supply of trays must be continuously replenished because of loss, theft, and damage so as to handle varying volumes of business.

For the foregoing reasons, the use of disposable trays has become increasingly popular. Various trays of this general type have been provided in the past; however, because of certain design characteristics they have been beset by one or more of the following shortcomings: (a) they were costly and difficult to manufacture; (b) they were not bio-degradable or not capable of being recycled; (c) they were inherently weak and awkward to handle; (d) they were incapable of properly accommodating various size beverage containers; (e) they could not be nested with similar trays so as to form a compact stack suitable for storage by or shipment to the store operator; and (f) they required presetting-up before they could be used by the customer.

SUMMARY OF THE INVENTION

Thus, it is an object of the invention to provide a molded carry-out tray which avoids all of the aforenoted shortcomings.

It is a further object to provide a carry-out tray which can readily accommodate a variety of articles and is formed of an inexpensive, lightweight, insulative material.

It is a still further object to provide a carry-out tray which, when loaded, can be conveniently carried by one hand of the customer.

Further and additional objects will appear from the description, accompanying drawings, and appended claims.

In accordance with one embodiment of the invention, a molded carry-out tray is provided for use in accommodating cup-shaped containers which vary in size and shape within a predetermined range. The tray is provided with at least one recessed pocket for removably accommodating and maintaining a cup-shaped container within a predetermined size range in an upright position while the tray is disposed in a substantially horizontal plane. The pocket includes a base section which subtends and supportingly engages the bottom of an accommodated container. Extending divergently upwardly from the base section are walls which terminate at a common plane disposed at a predetermined elevation relative to the base section. Disposed between adjacent walls and interconnecting corresponding portions thereof are corner sections which are connected to peripheral segments of the base section and extend upwardly therefrom. At least one of the corner sections terminates at the common plane and coacts with the walls to form at least a three-sided open top through which the lower portion of the container is inserted. Each wall includes an upper segment having the opposite sides thereof integrally connected to adjacent corner sections. In addition, each wall includes an outwardly yieldable lower segment which depends from the upper segment. The lower segment has a lower edge which is adjacent to, but spaced from, the periphery of the base section. The side edges of the lower segment extend upwardly from opposite ends of the lower edge and are spaced from corresponding side portions of the adjacent corner sections. Each corresponding side portion of a corner section is provided with an offset ledge which extends inwardly towards the center of the pocket and is spaced downwardly from the common plane.

DESCRIPTION

For a more complete understanding of the invention reference should be made to the drawings wherein:

FIG. 1 is a top plan view of one form of the improved carry-out tray.

FIGS. 2 and 3 are side elevational and bottom views, respectively, of the tray of FIG. 1.

FIG. 4 is an enlarged fragmentary top perspective view of one of the pockets provided in the tray of FIG. 1.

FIG. 5 is an enlarged fragmentary sectional view taken along line 5—5 of FIG. 1.

FIG. 6 is an enlarged fragmentary sectional view taken along line 6—6 of FIG. 1.

FIGS. 7 and 8 are top plan and side elevational views, respectively, of a second embodiment of the improved carry-out tray.

FIGS. 9 and 10 are top plan and side elevational views, respectively, of a third embodiment of the improved carry-out tray.

FIG. 11 is a top plan view of one of the pockets embodied in the tray and showing in concentric phantom lines the relative positions of the lower ends of three standard size cup-shaped containers, commonly used in fast-food restaurants for dispensing beverages to the customers, with respect to the walls defining the pocket.

FIG. 13 is similar to FIG. 4 and is a fragmentary perspective top view of the carry-out tray of FIG. 12.

FIGS. 14–17 are fragmentary enlarged sectional views taken respectively along lines 14—14, 15—15, 16—16, and 17—17 of FIG. 12.

Figure 12:
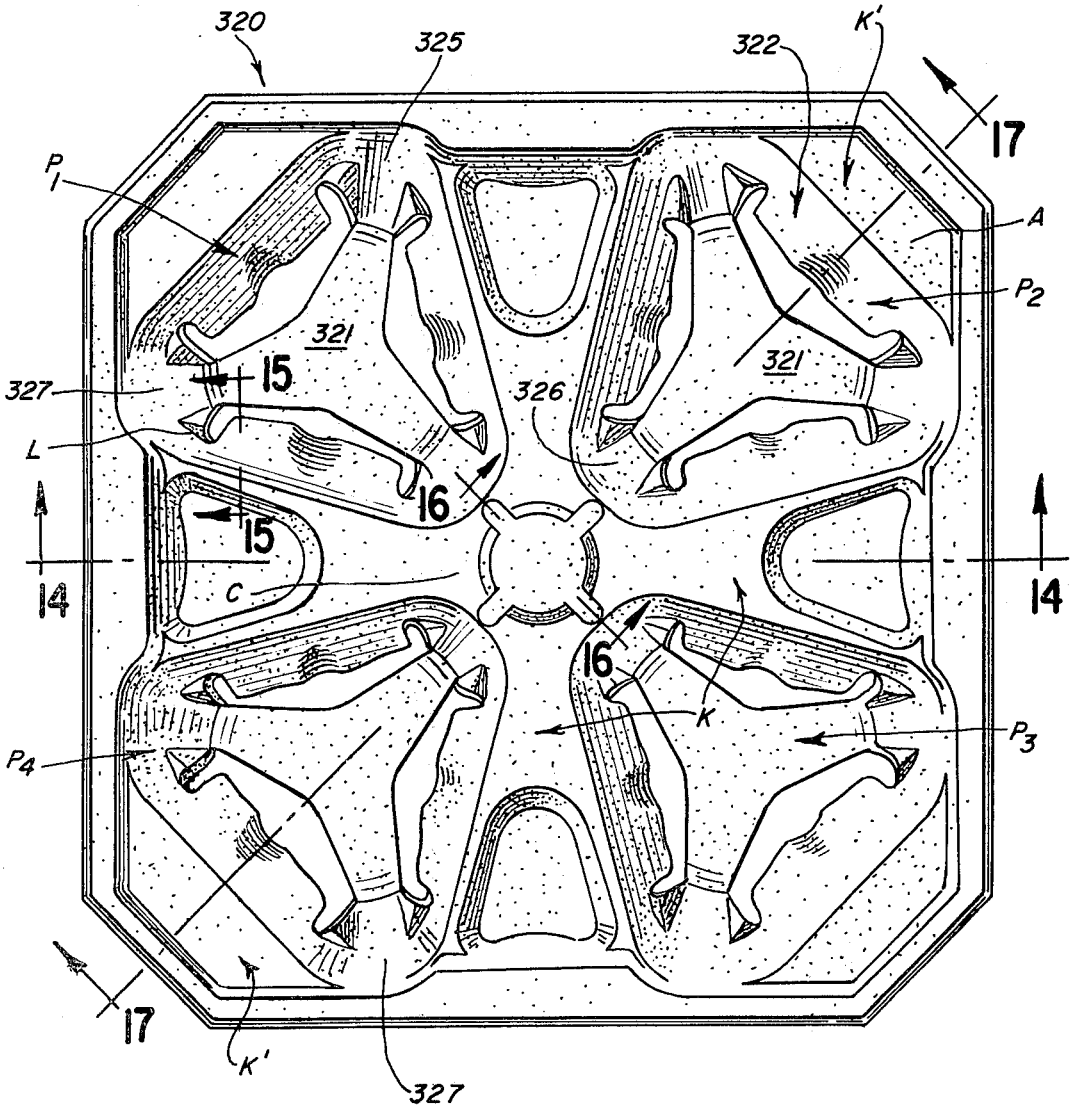
FIG. 12 is a top plan view of a fourth embodiment of the improved carry-out tray.

Referring now to the drawings and more particularly to FIGS. 1–3, one form 20 of the improved carry-out tray is shown which is preferably formed of a molded pulp material. Such material is particularly suitable because it is inexpensive and possessed of good thermal insulative properties. Other forms 120 and 220 and 320 of the carry-out tray are shown in FIGS. 7 and 9 and 12, respectively, and will be described more fully hereinafter.

Tray 20, as illustrated in FIG. 1, is provided with four recessed pockets $P_1$, $P_2$, $P_3$, and $P_4$, all of which are of like configuration and thus, only one of the pockets will be described in detail hereinafter. The pockets are symmetrically arranged about the center C of the tray. Each pocket is separated from an adjacent pocket by a shallow depression D which is substantially wedge-shaped with the narrow end $D_1$thereof adjacent the tray center C.

Each pocket is recessed a like amount from a common plane A which is defined by the open tops of the pockets. The plane A is delimited by a depending peripheral flange F which provides added stiffness and strength to the tray, thereby facilitating manual handling of a loaded tray.

Each pocket of the tray 20, 120, 220, or 320 may be of the same basic design. In the illustrated embodiments, each pocket is three-sided and includes a base section 21 which is adapted to subtend and supportingly engage the bottom of a container X, Y, Z. The container, in this instance, is of a conventional cup-shape, and is of a type commonly utilized by fast-food operators for dispensing beverages in small, medium, and large quantities. The side wall of the container is generally tapered so as to permit nesting of like size containers. The lower end of the side wall defines an annular bottom or end wall.

Extending divergently upwardly from the base section 21 of the pocket are walls 22, 23, 24. Disposed between adjacent walls and connected thereto are corner sections 25, 26, 27. The upper edges of the walls and corner sections terminate in plane A and coact with one another to form the open top for the pocket. Each pocket wall is preferably of like configuration and, as seen in FIG. 6, includes an upper segment 28 having the opposite side edges thereof integrally connected to the adjacent corner sections 25, 27. Integral with and depending from the wall upper segment 28 is an outwardly yieldable lower segment 30. The outward yieldability of the lower segment 30 permits the pocket to readily accommodate the medium and large size containers Y, Z, as well as the small size X, see FIG. 11. The lower segment 30 has the lower edge 30*a* thereof disposed adjacent to, but spaced from, the periphery of base section 21. Lower segment 30 is also provided with side edges 30*b* which extend upwardly from opposite ends of the lower edge 30*a*. The side edges 30*b* are spaced from corresponding side portions 25*a*, 27*a* of the corner sections by an elongated slot or slit S. As illustrated, the upper end of each slot may terminate at approximately the mid-height of the walls. If desired, the interior surface of the lower segment 30 (that is the surface facing towards the center of the pocket), may have the center portion thereof provided with a slight concave configuration. The curvature of the center portions of the lower segment interior surfaces may partially conform to the curved exterior of the side wall of the small size container X and thus, engage same and provide resilient lateral support for the accommodated container even though the container is inserted into and removed from the pocket several times. It is desirable that the center portion of the lower segment interior surface be only slightly curved so as not to impair the outward yieldability of the lower segment or cause the lower segment to assume a permanent set.

As noted in FIG. 4, the peripheral portions 21*a* of the base section, which are adjacent the lower edges 30*a* of the wall lower segments 30, are recessed a small amount so as to facilitate molding of the tray with conventional molding equipment.

Each side portion 25*a*, 27*a* of the corner sections 25, 27 has the upper end thereof offset inwardly so as to form a ledge L, see FIG. 5. The relative location of the ledges within a pocket is such as to provide lateral side wall support for the large size container Z when the latter is inserted to the fullest extent into the pocket. When the large size container is accommodated in the pocket, the wall lower segments 30 are outwardly deflected substantially the maximum amount.

As will be observed in FIG. 6, the lower end of the corner section is made integral at 21*b* with the periphery of the base section 21 and thus, provides support for the base section.

FIGS. 7–8 and 9–10 disclose modified forms 120, 220 of the improved trays, which besides pockets for beverage containers, also include enlarged recessed areas R for accommodating items such as sandwiches or the like. The pockets in trays 120, 220 are preferably of the type previously described with respect to tray 20. As will be observed, in tray 120 only two pockets $P_1$, $P_2$are provided, both being disposed to one side of recessed area R. If desired, tray 120 could be modified so that the two pockets would be separated by the recessed area. The depth of the recessed area R in both trays should preferably be the same as the depth of the pockets; thus, enabling each tray to assume a stable horizontal position when resting upon a supporting surface.

In tray 220, two pairs of pockets $P_1$, $P_2$, and $P_3$, $P_4$are provided and disposed on opposite sides of recessed area R. While only four pockets are shown in tray 220, it is to be understood that the number of pockets may be increased or decreased from that shown. Furthermore, the configuration of the area R may also be changed from that shown.

The recessed area in both trays includes a substantially planar floor section 50 which is delimited by upwardly diverging wall sections 51, 52 and corner sections 53 which interconnect the latter. The recessed area R is separated from the pockets by a land section 54 which is substantially coplanar with the open tops of the pockets.

FIGS. 12–17 disclose a fourth embodiment 320 of the improved carry-out tray and is particularly suitable where the loaded tray is likely to be manually carried by one hand of the customer or the person serving the customer. One handed manipulation of the loaded tray is a common occurrence in fast-food operations when the loaded tray is being passed by the server through a drive-up window to a customer sitting in a vehicle.

Tray 320 in the illustrated embodiment is provided with four pockets $P_1$, $P_2$, $P_3$, and $P_4$ which are symmetrically arranged about a center portion C. As in the case of tray 20, the pockets of tray 320 are preferably of like construction, and each has a configuration similar to that described with respect to tray 20. For convenience in understanding the pocket structure, parts thereof corresponding to the pocket parts of tray 20 will be given the same identifying numbers but in a 300 series.

In tray 320, the pocket walls 322 which are symmetrically arranged about the recessed base section 321, extend divergently upwardly therefrom and terminate in a common plane A. The walls of each pocket in tray 320 are interconnected by corner sections 325–27. Corner section 326 is disposed in close proximity to the center portion C of the tray and projects upwardly from base section 321 and terminates in plane A. The remaining two corner sections 325, 327 are disposed in close proximity to a raised peripheral rim Q which encompasses the tray. Rim Q, as seen more clearly in FIG. 14, has the upper surface thereof defining a second common plane B. Plane B is at a greater elevation relative to the pocket base section 321 than plane A. The raised rim Q is continuous throughout and thus, adds significantly to the rigidity of the tray 320.

As noted in FIG. 13, corner sections 325, 327 merge into the inner segment Q′ defining the rim Q. The outer segment Q″ of the rim Q extends downwardly and outwardly a slight amount, see FIGS. 14, 17. Preferably the outer segment Q″ depends a greater distance from plane B than the spacing between planes A and B.

Adjacent pockets in tray 320 are separated from one another by relatively wide planar lands K which extend in substantially radial directions from the center portion C of the tray 320. The outer distal portion of each land K terminates in a broad depression T which is shaped to conveniently accommodate the thumb of the person carrying the tray. The depression is separated from an adjacent pocket by a narrow substantially solid rib 360, see FIG. 15. The side of the rib adjacent the pocket is formed by the upper segment 328 of one of the walls of the pocket. Each rib extends from the outer end of land K to the inner wall Q′ of peripheral rim Q; thus, providing substantial stiffness to the center portion C of the tray.

The center portion C of the tray is provided with a raised segment C′ having the upper exposed surface thereof substantially flush with plane B, see FIG. 14. When tray 320 is formed of molded pulp, the raised segment C′ serves an important function during forming of the tray in preventing sag or distortion of the center portion C while the tray is disposed in an inverted position on a drying conveyor or rack.

Symmetrically arranged about the raised segment C′ and extending radially and downwardly from segment C′ to center portion C are a plurality of fillet-like protuberances C″ which prevent sticking together of a plurality of like trays when the latter are arranged in nested relation for storage or bulk shipping.

As seen in FIG. 12, each pocket has a triangular configuration and is so arranged within the tray that one of the three side walls thereof is disposed adjacent a peripheral corner of the tray 320. The upper edge of such wall is spaced from the tray corner but is connected to the inner surface Q′, of the rim Q by a second land K′. Lands K and K′ are substantially coplanar with one another and with plane A and thus, effectively retain the open tops of the pockets in proper spaced relation to each other and to the peripheral rim.

It will be noted in FIG. 12 that the width of the rim Q in the vicinity of the depression T is greater than the width of the remainder of the rim and thus provides added stiffness to the rim at the depressions T and also facilitates denesting of the trays when arranged in nested relation.

As aforenoted the structure of the pockets in both trays 20, 320 is substantially the same and each pocket wall includes a lower segment 30, 330 and an upper segment 28, 328. The opposite sides of the wall upper segment are integrally connected to the adjacent corner sections 25, 26, 27, or 325, 326, 327 so that the open top of the pocket will maintain a desired shape and will resist distortion. The lower segment 28, 328, on the other hand, is connected only to the wall upper segment and the bottom edge of the lower segment is spaced vertically outwardly from the periphery of the base section 321 and the side edges of the lower segment are spaced laterally from the adjacent corner sections. By reason of this arrangement the wall lower segments are yieldable outwardly so as to readily accommodate various size beverage containers or the like which are placed within the various pockets. Furthermore, by reason of the wall lower segment being connected to only the wall upper segment and not to either the base section or the adjacent corner sections as well, the lower segment when contacted by the accommodated container will not take a permanent set which would impair the capability of the wall segments to exert a resilient contact with the accommodated container even though the latter is repeatedly removed from the pocket.

In all forms of the carry-out trays 20, 120, 220, and 320 herein described, the pockets, recessed areas, depressions, and peripheral rims thereof have tapered interior and exterior wall surfaces, thereby enabling a plurality of like trays to be closely nested together so as to form a compact stack or bundle, suitable for bulk storage and for shipping. The ledges L and the solid ribs 360 serve to prevent over-compacting of the trays in a stack which might otherwise present a denesting problem.

While the pockets herein illustrated and described have a tapered triangular or three-sided configuration, it is to be understood, however, that the invention hereinafter claimed is not to be limited thereto. Square, hexagonal, or octagonal shaped pockets may also be utilized and will depend to a large extent on the shape and size of the containers to be accommodated in the tray pockets. Furthermore, the number of pockets and their location to each other or to other recessed areas may be varied from that shown without departing from the scope of the invention.

The improved carry-out tray is of simple inexpensive construction, is sturdy and convenient to manually carry when loaded. It is readily nestable with other like trays for storage or shipping and does not require any manual setting up before use.

We claim:

1. A molded carry-out tray for accommodating cup-shaped containers varying in size within a predetermined range, said tray comprising a continuous raised peripheral rim delimiting an area, at least one recessed pocket formed in said area for removably accommodating and maintaining a container in an upright position while said tray is disposed in a substantially horizontal plane, said pocket including a base section for subtending and supportingly engaging the bottom of an accommodated container; walls extending divergently upwardly from said base section and terminating at a predetermined elevation with respect to said base section, said rim having a top disposed at a greater elevation from said base section than the upper termination of said pocket walls; and corner sections intermediate said walls and interconnecting corresponding portions of adjacent walls, said corner sections being connected to peripheral segments of said base section and extending upwardly therefrom, said corner sections terminating at substantially the same elevation as said walls, said walls and corner sections coacting to define an open top; each wall being provided with an upper segment integrally connected to adjacent corner sections, and an outwardly yieldable lower segment having a lower edge disposed adjacent to, but spaced from, the periphery of said base section, said lower segments having side edges extending upwardly from opposite ends of said lower edge, said side edges being spaced from corresponding side portions of the adjacent corner sections, each corresponding side portion of a corner section being provided with an inwardly offset ledge, said ledge being spaced from the open top of said pocket.

2. The tray of claim 1 wherein the upper and lower segments of each wall are integral with one another.

3. The tray of claim 1 wherein each corner section is provided with a pair of relatively spaced ledges, the pairs of ledges of said corner sections coacting with one another for supportingly engaging the exterior of at least the largest container within said predetermined range accommodated by said pocket.

4. The tray of claim 2 wherein the lower segments are symmetrically arranged about the periphery of said base section.

5. The tray of claim 1 wherein the pocket is disposed to one side of an enlarged recessed area, the latter being disposed within the area deliminated by said rim and separated from said pocket by a land section disposed in substantially coplanar relation with said pocket open top; said recessed area including a floor section delimited by upwardly and divergently extending wall panels, said floor section and said pocket base section being in substantially coplanar relation.

6. A molded carry-out tray for accommodating cup-shaped containers varying in size within a predetermined range, said tray comprising a plurality of adjacent recessed portions, at least one of said portions being a pocket for removably accommodating and maintaining a container within the predetermined range in an upright position while said tray is disposed in a substantially horizontal plane; a finger-accommodating depression disposed intermediate said recessed portions; and a continuous, peripheral reinforcing rim encompassing the plurality of recessed portions, the top of said rim defining a first plane, said depression being proximate said rim; said pocket including a base section for subtending and supportingly engaging the bottom of an accommodated container within the predetermined range; walls extending divergently upwardly from said base section and terminating at a predetermined elevation with respect to said base section and beneath said first plane, each wall having an upper segment and a yieldable lower segment extending from said upper segment and spaced from said base section, said wall lower segments being adapted to resiliently engage the container accommodated in the pocket, and corner sections intermediate said walls and interconnecting corresponding upper segments of adjacent walls, said corner sections being integrally connected to peripheral segments of said base section and extending divergently upwardly therefrom, said corner sections being spaced from corresponding lower segments of said adjacent walls, predetermined corner sections terminating at substantially the same elevation as said walls, said corner sections and said wall upper segments coacting to define an open top of greater area than said base section, said pocket open top being separated from said finger-accommodating depression by a stiffening rib, each corner section being provided with an inwardly offset ledge spaced downwardly from the open top and laterally from the adjacent wall lower segment.

7. The tray of claim 6 wherein the recessed portions are recessed a substantially like amount and define a second plane disposed in spaced substantially parallel relation with said first plane.

8. The tray of claim 7 wherein said recessed portions are pockets of substantially like configuration.

9. The tray of claim 8 wherein said pockets are substantially symmetrically arranged about a center portion of said tray.

10. The tray of claim 9 wherein the tray center portion includes a raised segment disposed in substantially flush relation with the first plane.

11. The tray of claim 10 wherein there is a finger-accommodating depression intermediate each pair of adjacent pockets, a peripheral segment of each depression being separated from the raised segment of the tray center portion by a substantially planar first land, said first lands defining a third plane disposed intermediate said first and second planes.

12. The tray of claim 6 wherein the stiffening rib is partially formed by the upper segment of an adjacent pocket wall.

13. The tray of claim 11 wherein a wall of each pocket is separated from and connected to an adjacent segment of the rim by a planar second land.

14. The tray of claim 13 wherein the first and second lands define said third plane.

15. The tray of claim 11 wherein adjacent pockets are separated from one another by the coaction of a depression and a first land.

16. The tray of claim 6 wherein the lower segment of each pocket wall has the lower edge thereof spaced upwardly and outwardly from the periphery of said base section, and the side edges of the lower segment are laterally spaced from the adjacent corner section.

17. The tray of claim 6 wherein the upper and lower segments of a pocket wall are interconnected at substantially the mid-height of said wall.

* * * * *